US006939210B2

(12) United States Patent
Polyak et al.

(10) Patent No.: US 6,939,210 B2
(45) Date of Patent: Sep. 6, 2005

(54) SLURRY DELIVERY ARM

(75) Inventors: Alexander S. Polyak, San Jose, CA (US); Avi Tepman, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 30 days.

(21) Appl. No.: 10/428,914

(22) Filed: May 2, 2003

(65) Prior Publication Data

US 2004/0229549 A1 Nov. 18, 2004

(51) Int. Cl.[7] ..... B24B 9/00

(52) U.S. Cl. ..... 451/60; 451/41; 451/36; 451/446

(58) Field of Search ..... 451/41, 60, 36, 451/446

(56) References Cited

U.S. PATENT DOCUMENTS 6,398,627 B1 * 6/2002 Chiou et al. ..... 451/72
6,413,154 B1 * 7/2002 Togawa et al. ..... 451/285
6,488,566 B2 * 12/2002 Sandhu et al. ..... 451/5
6,551,174 B1 * 4/2003 Brown et al. ..... 451/41

FOREIGN PATENT DOCUMENTS

WO 00/51168 8/2000 ..... H01L/00/00

OTHER PUBLICATIONS

U.S. Appl. No. 09/921,588, filed Aug. 2, 2001, Withers et al.
U.S. Appl. No. 10/131,638, filed Apr. 22, 2001, Vereen et al.

* cited by examiner

*Primary Examiner*—Eileen P. Morgan
(74) *Attorney, Agent, or Firm*—Moser, Patterson & Sheridan

(57) ABSTRACT

A polishing fluid delivery apparatus has been provided that in one embodiment includes a support member, a dispense arm, a polishing fluid delivery tube and a variable restricting device. The dispense arm extends from an upper portion of the support member and has an outlet of the delivery tube coupled thereto. The restricting device interfaces with the delivery tube and is adapted to provide a variable restriction to flow passing through the delivery tube. In another embodiment, the restricting device is a pinch valve and the tube in continuous from the outlet to beyond a portion that interfaces with the pinch valve. In yet another embodiment, the position of the delivery arm is controllable.

31 Claims, 7 Drawing Sheets

SLURRY DELIVERY ARM

BACKGROUND OF THE INVENTION

1. Field of the Invention

Embodiments of the present invention generally relate to a method and apparatus for dispensing polishing fluids in a chemical mechanical polishing system.

2. Description of the Related Art

Chemical mechanical polishing is one process commonly used in the manufacture of high-density integrated circuits. Chemical mechanical polishing is utilized to planarize a layer of material deposited on a semiconductor wafer by moving the substrate in contact with a polishing surface while in the presence of a polishing fluid. Material is removed from the surface of the substrate that is in contact with the polishing surface through a combination of chemical and mechanical activity. One type of polishing fluid commonly used in chemical mechanical polishing applications is a slurry containing chemical agents and abrasive particles. The abrasive particles in the slurry enhance the mechanical removal of material from the substrate while exposing the underlying surface to the chemical agents in the polishing fluid.

Polishing fluid is typically provided to the polishing surface through a delivery arm that is positioned over the polishing surface during processing. The dispense point (i.e., the point at which the polishing fluid flows from a delivery tube to the polishing surface), and the amount and concentration of polishing fluid provided to the polishing surface are attributes that impact the quality of substrate processing. To ensure acceptable polishing results, conventional polishing fluid delivery systems rely on detent mechanisms to ensure repeatable positioning of the polishing fluid delivery arm at a pre-defined dispense location along with various flow control devices utilized to monitor and control the amount and concentration of polishing fluid delivered to the polishing surface.

One problem associated with this conventional arrangement is that the polishing fluid delivery arm is limited to the pre-defined position wherein the detent mechanism engages the arm. Thus, control of the dispense point on the polishing surface is limited to physically changing the delivery tube's position along the arm. Thus, in order to change the dispense point to achieve a desired processing result, polishing must be interrupted to allow for service personnel to mechanically adjust the position of the nozzles along the length of the slurry delivery arm, thereby increasing the risk of equipment damage and disadvantageously decreasing substrate throughput.

Another issue affecting many conventional polishing fluid delivery systems is the tendency of abrasive particles within the slurry to attach and agglomerate at tube fittings and around flow control components. For example, the interfaces between the slurry delivery tube and tees, valves, restrictors or other devices include small seams or gaps along the flow path where abrasive particles from within the slurry tend to adhere and conglomerate. As the number of abrasive particles accumulating at these locations grows, chains or groups of the conglomerated particles break free and travel downstream through the delivery tube to the polishing surface where they come in contact with the surface of the substrate being polished. These conglomerated particles often cause scratching of the substrate surface and defect generation. Therefore, it would be desirable to minimize and/or eliminate any seams along the slurry flow path to minimize the introduction of conglomerated particles to the polishing surface.

Therefore, there is a need for an improved slurry delivery system.

SUMMARY OF THE INVENTION

A polishing fluid delivery apparatus has been provided that in one embodiment includes a support member, a dispense arm, at least one polishing fluid delivery tube and a variable restricting device. The dispense arm extends from an upper portion of the support member and has an outlet of the delivery tube coupled thereto. The restricting device interfaces with the delivery tube and is adapted to provide a variable restriction to flow passing through the delivery tube. In another embodiment, the restricting device is a pinch valve and the tube is continuous from the outlet to beyond a portion that interfaces with the pinch valve. In yet another embodiment, the position of the delivery arm is controllable.

BRIEF DESCRIPTION OF THE DRAWINGS

A more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION

Figure 1:
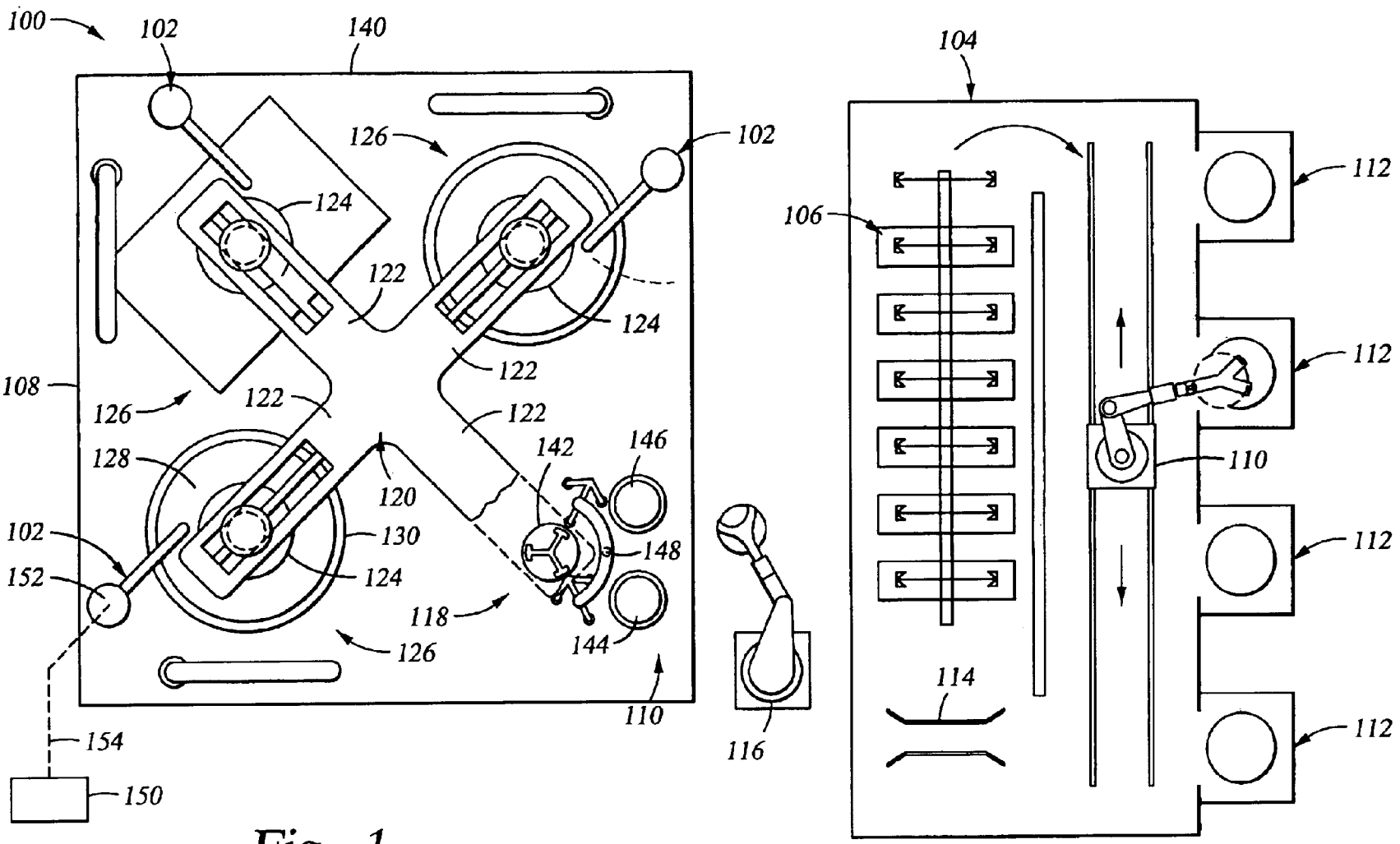
FIG. 1 is a top view of an illustrative chemical mechanical polishing system having one embodiment of a polishing fluid delivery system.

FIG. 1 is a top view of an illustrative chemical mechanical polishing system 100 having one embodiment of a polishing fluid delivery system 102 of the present invention. The chemical mechanical polishing system 100 generally includes a factory interface 104, a cleaner 106 and a polisher 108. One polishing system 100 that may be adapted to benefit from the invention is a REFLEXION® chemical mechanical polishing system, available from Applied Materials, Inc., located in Santa Clara, Calif. Another polishing system 100 that may be adapted to benefit from the invention is described in U.S. Pat. No. 6,244,356, issued Jul. 2, 2002 to Birang, et al., which is incorporated by reference in its entirety.

In one embodiment, the factory interface 104 includes a first or interface robot 110 adapted to transfer substrates from one or more substrate storage cassettes 112 to a first transfer station 114. A second robot 116 is positioned between the factory interface 104 and the polisher 108 and is configured to transfer substrates between the first transfer station 114 of the factory interface 104 and a second transfer station 118 disposed on the polisher 108. The cleaner 106 is typically disposed in or adjacent to the factory interface 104 and is adapted to clean and dry substrates returning from the polisher 108 before being returned to the substrate storage cassettes by the interface robot 110.

The polisher 108 includes at least one polishing station 126 and a transfer device 120 disposed on a base 140. In the embodiment depicted in FIG. 1, the polisher 108 includes three polishing stations 126, each having a platen 130 that supports a polishing material 128 on which the substrate is processed.

The transfer device 120 supports at least one polishing head 124 that retains the substrate during processing. In the embodiment depicted in FIG. 1, the transfer device 120 is a carousel supporting one polishing head 124 on each of four arms 122. One arm 122 is cutaway to show the second transfer station 118. The transfer device 120 facilitates moving substrates retained in each polishing head 124 between the second transfer station 118 and the polishing stations 126 where substrates are processed. The polishing head 124 is configured to retain a substrate while polishing. The polishing head 124 is coupled to a transport mechanism that is configured to move the substrate retained in the polishing head 124 between the transfer station 118 and the polishing stations 126. One polishing head 124 that may be adapted to benefit from the invention is a TITAN HEAD™ substrate carrier, available from Applied Materials, Inc.

The second transfer station 118 includes a load cup 142, an input buffer 144, an output buffer 142 and a transfer station robot 148. The input buffer 144 accepts a substrate being transferred to the polisher 108 from the second robot 116. The transfer station robot 148 transfers the substrate from the input buffer 144 to the load cup 142. The load cup 142 transfers the substrate vertically to the polishing head 124, which retains the substrate during processing. Polished substrates are transferred from the polishing head 124 to the load cup 142, and then moved by the transfer station robot 148 to the output buffer 142. From the output buffer 142, polished substrates are transferred to the first transfer station 114 by the second robot 116 and then transferred through the cleaner 106. One second transfer station 118 that may be adapted to benefit from the invention is described in U.S. Pat. No. 6,156,124, issued Dec. 5, 2000, to Tobin, which is incorporated by reference in its entirety.

In one embodiment, the polishing station 126 includes a platen 130 that supports a polishing material 128. During processing, the substrate is held against the polishing material 128 by the polishing head 124. The platen 130 rotates to provide at least a portion of the polishing motion imparted between the substrate and the polishing material 128. Alternatively, the polishing motion may be imparted by moving at least one of the polishing head 124 or polishing material 128 in a linear, orbital, random, rotary or other motion.

The polishing material 128 may be comprised of a foamed polymer, such as polyurethane, or may be a fixed abrasive material. Fixed abrasive material generally includes a plurality of abrasive elements disposed on a flexible backing. In one embodiment, the abrasive elements are comprised of geometric shapes formed from abrasive particles suspended in a polymer binder. The polishing material 128 may be in either pad or web form.

The polishing fluid delivery system 102 includes at least one polishing fluid supply 150 coupled to at least one polishing fluid delivery arm assembly 152. Generally, each polishing station 126 is equipped with a respective delivery arm assembly 152 positioned proximate to the respective platen 130. In the embodiment depicted in FIG. 1, the three polishing stations 126 each have one delivery arm assembly 152 associated therewith. Each polishing fluid delivery arm assembly 152 may be coupled to a dedicated polishing fluid supply 150, or may be configured to receive polishing fluid from a single or multiple shared polishing fluid supplies. Each delivery arm assembly 152 includes at least one fluid delivery tube 154 coupled to the polishing fluid supply 150.

Figure 2:
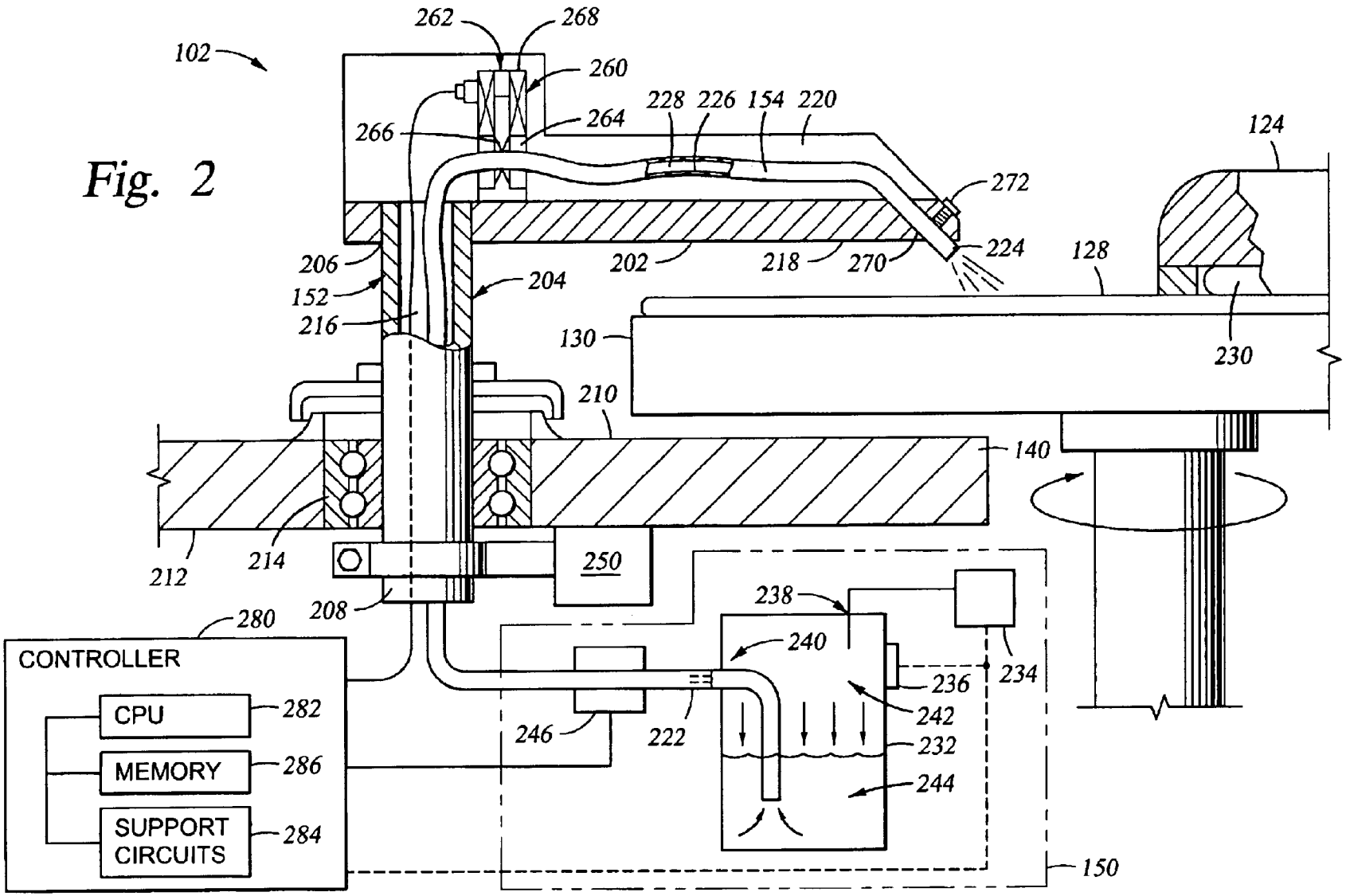
FIG. 2 is a sectional view of a polishing fluid delivery arm of the polishing fluid delivery system of FIG. 1.

FIG. 2 depicts a sectional view of one embodiment of the polishing fluid delivery arm assembly 152. The polishing fluid delivery arm assembly 152 includes a dispense arm 202 affixed to and extending laterally from the upper portion 206 of a support member 204 above a top surface 210 of the base 140. The lower portion 208 of the support member 204 is rotatably mounted in and extends through a bottom 212 of the base 140. A bearing assembly 214 is disposed between the support member 204 and the base 140 to allow the dispense arm 202 extending from the upper portion 206 of the support member 204 to be rotated between a standby or purge position clear of the platen 130 and a dispense position over the polishing material 128 (as shown in FIG. 1).

For simplicity in the embodiment depicted in FIG. 2, a single delivery tube 154 is shown routed along the dispense arm 202 for supplying polishing fluid to the polishing material 128 disposed on the platen 130. However, any number of delivery tubes 154 may be utilized to supply polishing fluid from a common dispense arm 202 to a single platen 130. The delivery tube is comprised of a resilient and flexible material, such as silicone. The interior of the tube must be substantially free of interior anomalies.

In one embodiment, the delivery tube 154 is routed from an inlet end 222 coupled to the polishing supply 150 through a passage 216 formed in the support member 204 and outward along a channel 220 disposed in the dispense arm 202. An outlet end 224 of the delivery tube 154 is positioned at a distal end 218 of the dispense arm 202. The distal end 218 includes a tube receiving passage 270 through which the outlet end 224 of the delivery tube 154 is disposed. The delivery tube 154 is secured in the passage 270 by a clamp 272, which in one embodiment is a set screw. Alternatively, the delivery tube 154 may be positioned at other locations along the length of the dispense arm 202. In embodiments utilizing multiple delivery tubes 154, any one of the tubes may be fixed to or positionable along the dispense arm 202, and have their outlet ends 224 grouped in a common location or spaced apart to dispense polishing fluid at predefined locations across the diameter of the polishing material 128.

In one embodiment, the delivery tube 154 is a single, continuous member running from its inlet to outlet ends 222, 224. The delivery tube 154 has no crevasses, seams or other anomalies present along its inner surface 226 that would otherwise provide attachment points for abrasive or other particles that may be entrained or form in the polishing fluid, thereby advantageously decreasing the probability of particle agglomeration within the tube and there release to the polishing material 128 where they may contact a substrate 130 being processed. The substantial elimination of release of agglomerated particles results in increased product yield by reducing scratching and substrate defects. Alternatively, the delivery tube 154 may be segmented, but with increased potential for diminished yield.

In one embodiment, the polishing fluid supply 150 includes a pressure vessel 232 and a pressure control system 234. The pressure vessel 232 contains a polishing fluid 244, and may be optionally coupled to a bulk supply system (not shown) for periodic replenishment of polishing fluid. The pressure vessel 232 has an inlet port 238 and outlet port 240. The inlet port 238 is coupled to the pressure control system 234 while the outlet port 240 is coupled to inlet end 222 of the delivery tube 154.

The pressure control system 234 generally controls the pressure within and/or delivers gas to the pressure vessel 232. Gas 242 within the pressure vessel 232 imparts a pressure on the polishing fluid 244 residing in the pressure vessel 232, thereby driving the polishing fluid 244 through the outlet port 240 and the delivery tube 154, and ultimately flowing out the outlet end 224 to the polishing material 128. The pressure control system 234 may include regulators, pumps and the like to control the pressure applied to the polishing fluid 244 disposed in the pressure vessel 232. A pressure sensor 236 is coupled to the pressure vessel 232 to provide a metric indicative of the pressure within the pressure vessel 232.

A flow sensor 246 is interfaced with the delivery tube 154 to provide a metric indicative of the flow of polishing fluid passing therethrough. In embodiments where the delivery tube 154 is configured to flow fluids not prone to particle formation, for example de-ionized water and chemical reagents, flow sensors that engage the fluid, such as paddle wheels and the like may be utilized. In embodiments where the delivery tube 154 is configured to flow fluids containing particles and/or prone to particle formation, such as abrasive containing slurries, non-intrusive flow sensors, such as sonic flow transducers and the like may be utilized to maintain a continuous non-interrupted inner wall integrity of the delivery tube 154 between the polishing fluid supply 150 and the outlet end 224 of the delivery tube 154.

To enhance control over the polishing fluid flowing through the polishing fluid delivery tube 154, a variable restricting device 260 is utilized to interface with the delivery tube 154. In the embodiment depicted in FIG. 2, the restricting device 260 is configured to apply a bias to the exterior of the delivery tube 154, resulting in a reduction of the interior sectional area 228 of the delivery tube 154 resulting in a flow restriction to the polishing fluid flowing therethrough. As the restricting device 260 is non-intrusive, i.e., does not create a seam in the flow path or otherwise contact the polishing fluid flowing through the tube, flow attributes, such as backpressure, which may be utilized to control the flow through the tube, may be controlled without creating surface conditions such as a seam that encourages the attachment and build-up of particles.

Moreover, as the restricting device 260 is configured to provide a variable restriction, the flow of polishing fluid through the delivery tube 154 to the polishing material 128 may be controlled through a full range of flow conditions as desired. For example, the restricting device 260 may completely close the interior sectional area 228 of the delivery tube 154 resulting in zero polishing fluid flow. The restricting device 260 may also partially close the delivery tube 154 to a predefined percentage of the open sectional area 228, or the restricting device 260 may leave the sectional area 228 of the delivery tube 154 substantially open in a full flow condition. One benefit of completely opening the delivery tube 154 to a full flow condition is that the increased flow rate through the delivery tube 154 sweeps any particles that may have attached to the tube walls or other components disposed in the polishing fluid flow path out of the delivery tube 154 during a purge cycle between polishing, thereby further reducing incidence of agglomerated particles reaching the substrate during processing.

In one embodiment, the restricting device 260 is a pinch valve 262 having a slot 264 for receiving the delivery tube 154. The pinch valve 262 includes an actuation bar 266 coupled to an actuator 268 that selectively biases the bar 266 against the exterior of the delivery tube 154 to control the amount that the inner sectional area 228 of the delivery tube 154 is open to flow.

The pinch valve 262 may be positioned anywhere along the length of the delivery tube 154. In the embodiment depicted in FIG. 2, the pinch valve 262 is coupled to at least one of the dispense arm 202 or support member 204 of the delivery arm assembly 152.

The pinch valve's actuator 268 may be a solenoid, linear actuator, cam, electric motor and ball screw, pneumatic cylinder, hydraulic cylinder or other device capable of biasing the delivery tube 154 to control flow therethrough. In one embodiment, the actuator 268 is configured to apply a controlled actuation pressure, thereby allowing the inner sectional area 228 of the delivery tube 154 to be controlled between any incremental opening amount between completely closed to completely open. In another embodiment, the actuator 288 variably controls the stroke distance of the bar 266, thereby allowing the inner sectional area 228 of the delivery tube 154 to be set at a predefined percentage of full open.

To facilitate control of the system 100 as described above, a controller 280 is coupled to the chemical mechanical polishing system 100. The controller 280 includes a CPU 282, support circuits 284 and memory 286. The CPU 282 may be one of any form of computer processor that can be used in an industrial setting for controlling various chambers and subprocessors. The memory 286 is coupled to the CPU 282. The memory 286, or computer-readable medium, may be one or more of readily available memory such as random access memory (RAM), read only memory (ROM), floppy disk, hard disk, or any other form of digital storage, local or remote. The support circuits 284 are coupled to the CPU 282 for supporting the processor in a conventional manner. These circuits include cache, power supplies, clock circuits, input/output circuitry and subsystems, and the like. A process, for example a polishing process described below, is generally stored in the memory 286, typically as a software routine. The software routine may also be stored and/or executed by a second CPU (not shown) that is remotely located from the hardware being controlled by the CPU.

Although the process of the present invention is discussed as being implemented as a software routine, some of the method steps that are disclosed therein may be performed in hardware as well as by the software controller. As such, the invention may be implemented in software as executed upon a computer system, in hardware as an application specific integrated circuit or other type of hardware implementation, or a combination of software and hardware.

In one embodiment, the pressure control system 234, the pressure sensor 236, flow sensor 246 and restricting device 260 are coupled to the controller 280 to allow closed loop control over the amount of polishing fluid flowing through the delivery tube 154. The controller 280 compares the sensed flow value resolved from the metric provided by the flow sensor 246 with a target value. In response, the controller 280 instructs at least one of the pressure within the pressure vessel 232 (as controlled by the pressure control system 234) and the restriction (i.e., backpressure) created by the restricting device 260 (as controlled by the open area of the delivery tube 154) to be adjusted so that the sensed flow is maintained at substantially equal the target value.

Figure 6:
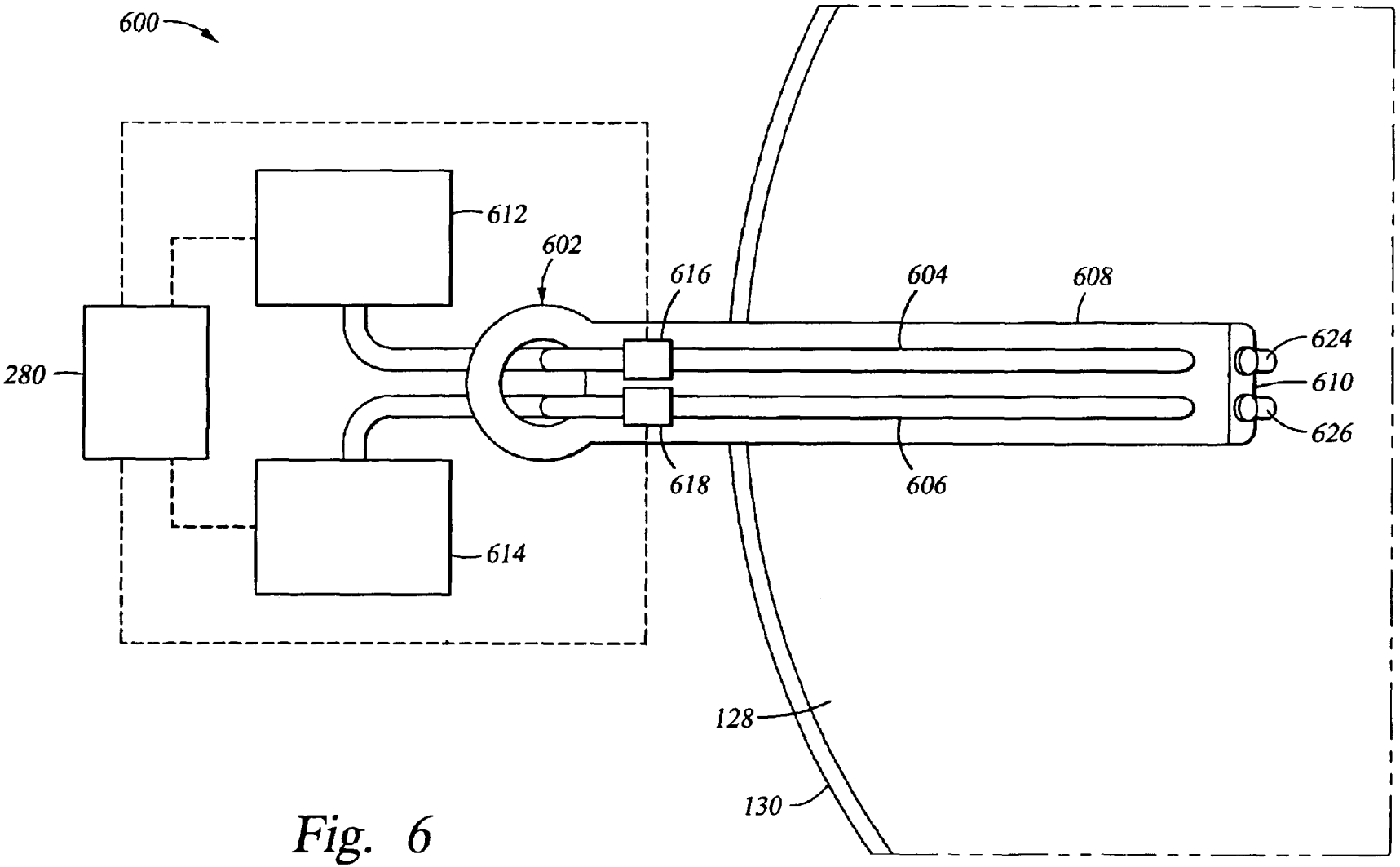
FIGS. 6–7 are simplified top views of other embodiments of a polish fluid delivery system.
Figure 7:
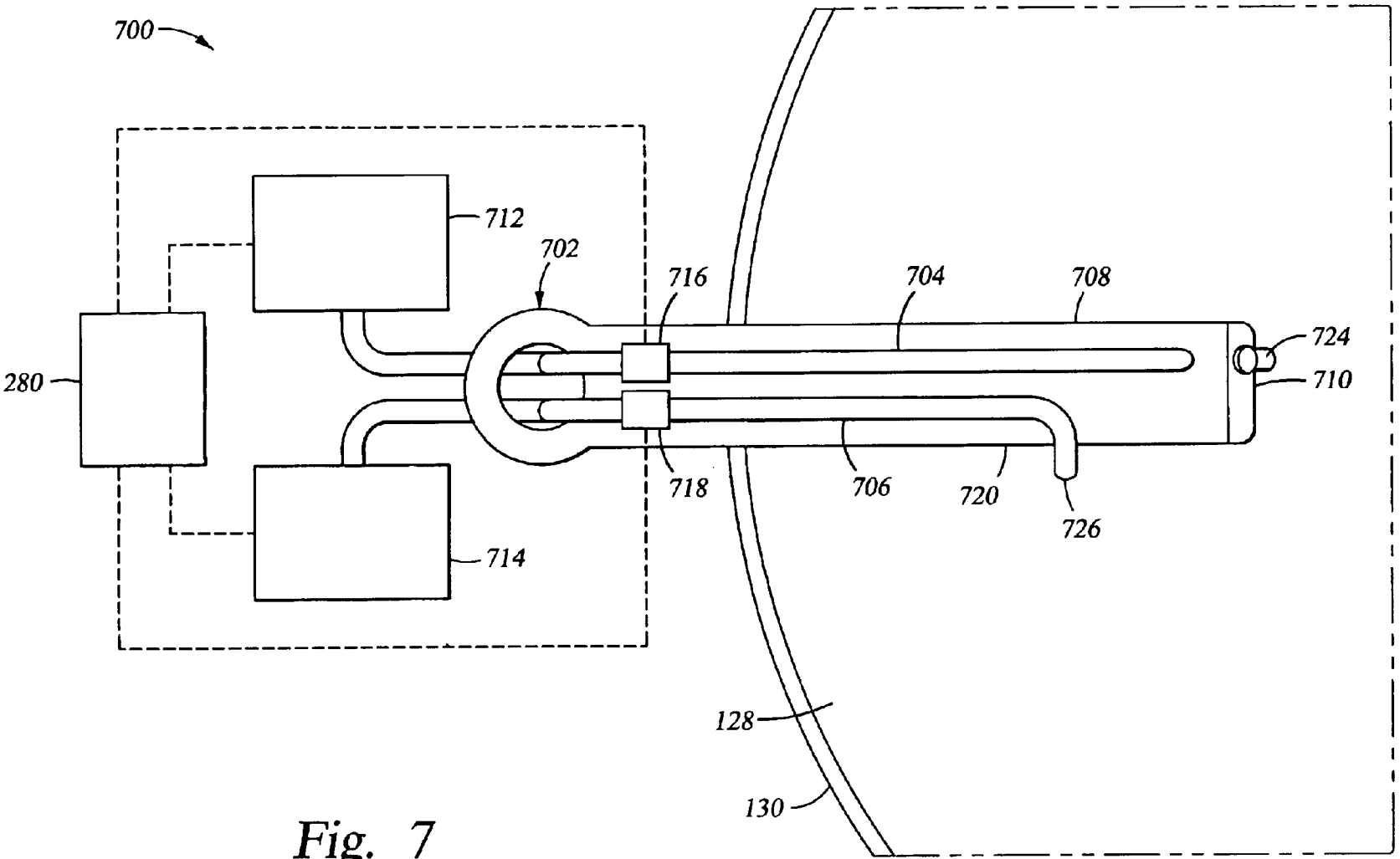

FIGS. 6–7 depict alternate embodiments of polishing fluid delivery systems that are adapted to control the distribution of polishing fluid on the surface of a polishing material 128. In the embodiment depicted in FIG. 6, a polishing fluid delivery assembly 600 includes a delivery arm assembly 602 having a first delivery tube 604 and a second delivery tube 606 coupled to a dispense arm 608. Outlet ends 624, 626 of the tubes 604, 606 are positioned at a distal end 610 of the dispense arm 608.

The first delivery tube 604 is coupled to a first fluid source 612 through a variable restricting device 616. The second delivery tube 606 is coupled to a second fluid source 614 through a second restricting device 618. In one embodiment, the first fluid source 612 may be configured to provide one component of the polishing fluid while the second fluid source 614 may be configured to provide another component of the polishing fluid such that the components of the polishing fluid provided by the supplies 612, 614 are mixed on the polishing material 128 after flowing from the outlets 624, 626 of the tubes 604, 606.

A controller 280 interfaces with the supplies 612, 614 and restricting devices 616, 618 in the manner described above that the ratio between the fluid supplied through the first tube 604 and the second tube 606 may be maintained at a predetermined value, or changed as desired to yield a desired polishing result. In one example, the first fluid source 612 may provide a slurry while the second fluid source 614 provides deionized water. By controlling the fluid flows through each tube 604, 606, a controlled slurry flow from the first delivery tube 604 is diluted on the polishing materials 128 by a controlled water flow from the second delivery tube 606, thereby allowing the concentration of polishing fluid disposed on the polishing material 128 to be varied as required, for example, to polish a specific material or in-situ while polishing a single substrate.

In the embodiment depicted in FIG. 7, a polishing fluid delivery assembly 700 includes a delivery arm assembly 702 having a first delivery tube 704 and a second delivery tube 706 coupled to a dispense arm 708. The outlet end 724 of the first delivery tube 704 is positioned at a distal end 710 of the dispense arm 708. The outlet end 726 of the second delivery tube 706 is positioned along a lateral side 720 of the dispense arm 708.

The first delivery tube 704 is coupled to a first fluid source 712 through a variable restricting device 716. The second delivery tube 706 is coupled to a second fluid source 714 through a second restricting device 718. In one embodiment, the first and second fluid sources 712, 174 may be configured to provide the same concentration of polishing fluid, and as such, may be combined as a single source.

A controller 280 interfaces with the supplies 712, 714 and restricting devices 716, 718 as described above so that the ratio between the fluid supplied through the first tube 704 and the second tube 706 may be maintained at a predetermined value, or changed as desired to yield a desired polishing result. In one example, the first fluid source 712 may provide a greater flow of polishing fluid through the first delivery tube 704 as compared to the flow through the second delivery tube 706, thereby causing the center of the substrate to be polished at a rate different than the edge. By controlling the fluid flows through each tube 704, 706, the rate of polishing across the profile of the substrate may be controlled from substrate to substrate, or in-situ during the polishing of a single substrate.

In another embodiment, the first and second fluid sources 172, 174 may be configured to provide the different components or polishing fluid or different types of polishing fluid. The controller 280 enables the ratio of fluid supplied through the first tube 704 end the second tube 706 may be controlled, thereby facilitating control over the rate of polishing across the profile of the substrate.

Figure 3A:
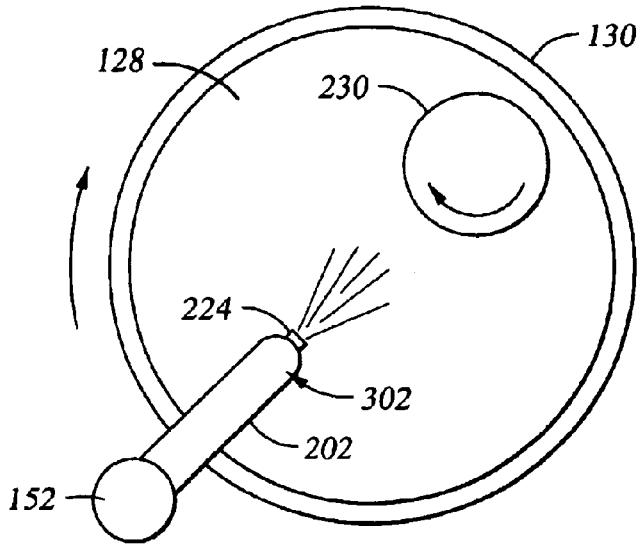
FIGS. 3A–C are simplified top views of the polishing fluid delivery arm in various positions.
Figure 3B:
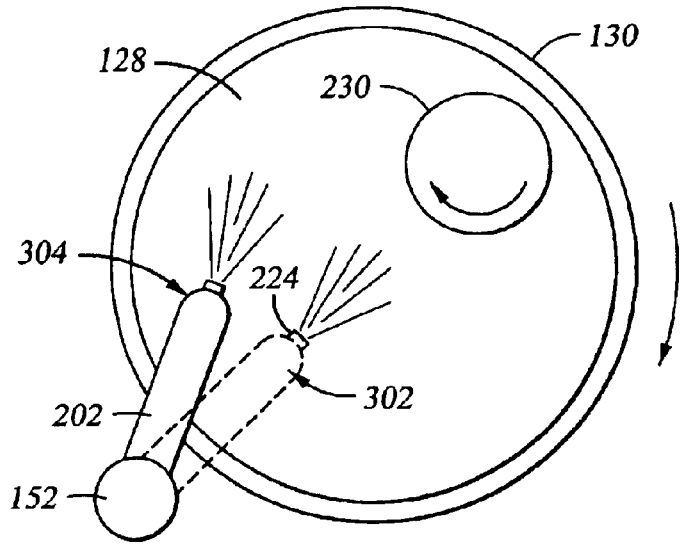
Figure 3C:
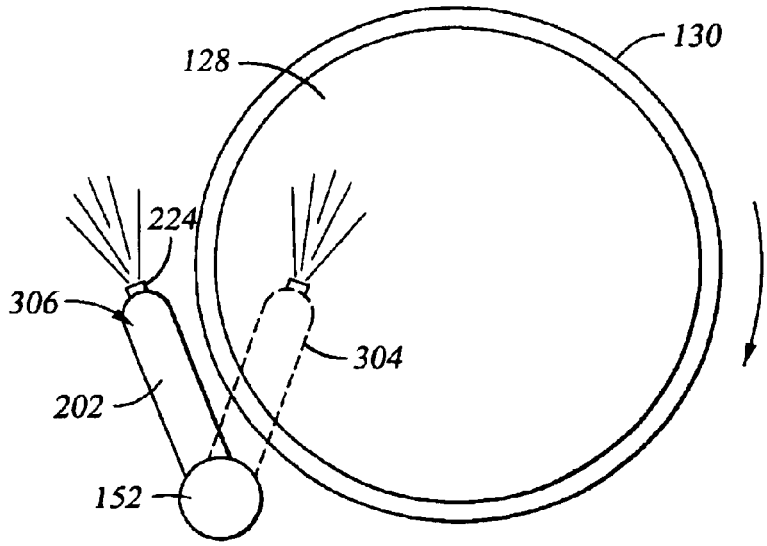

Returning to FIG. 2, the delivery arm assembly 152 additionally includes an actuator 250 coupled to the lower portion 208 of the support member 204 to control the angular orientation of the dispense arm 202. The actuator 250 may be a gear motor, a harmonic drive, a linear actuator, a motorized lead screw, a hydraulic cylinder, a pneumatic cylinder or other device suitable for imparting rotation to the dispense arm 202 about the support member 204. The actuator 250, in response to instructions from the controller 280, rotates the support member 204 and dispense arm 202, thereby controlling the position of the outlet end 224 of the delivery tube 154 over the polishing material 128, for example, between a first dispense position 302, a second dispense position 304 and a purge position 306, as shown in the simplified top view of the polishing fluid delivery arm assembly depicted in FIGS. 3A–C. In this manner, the distribution of polishing fluid across the width of the polishing material 128 may be controlled by adjusting the relative position of the outlet end 224 (i.e., dispense points) and the polishing material 128. As the distribution of polishing fluid interfacing with the substrate on the polishing material 128 is changed, the rate of material removal (e.g., polishing) may be controlled as desired. For example, more polishing fluid may be provided to the areas of the polishing material 128 that predominantly contact the perimeter of the substrate, thereby polishing the perimeter of the substrate faster than the center.

Figure 4:
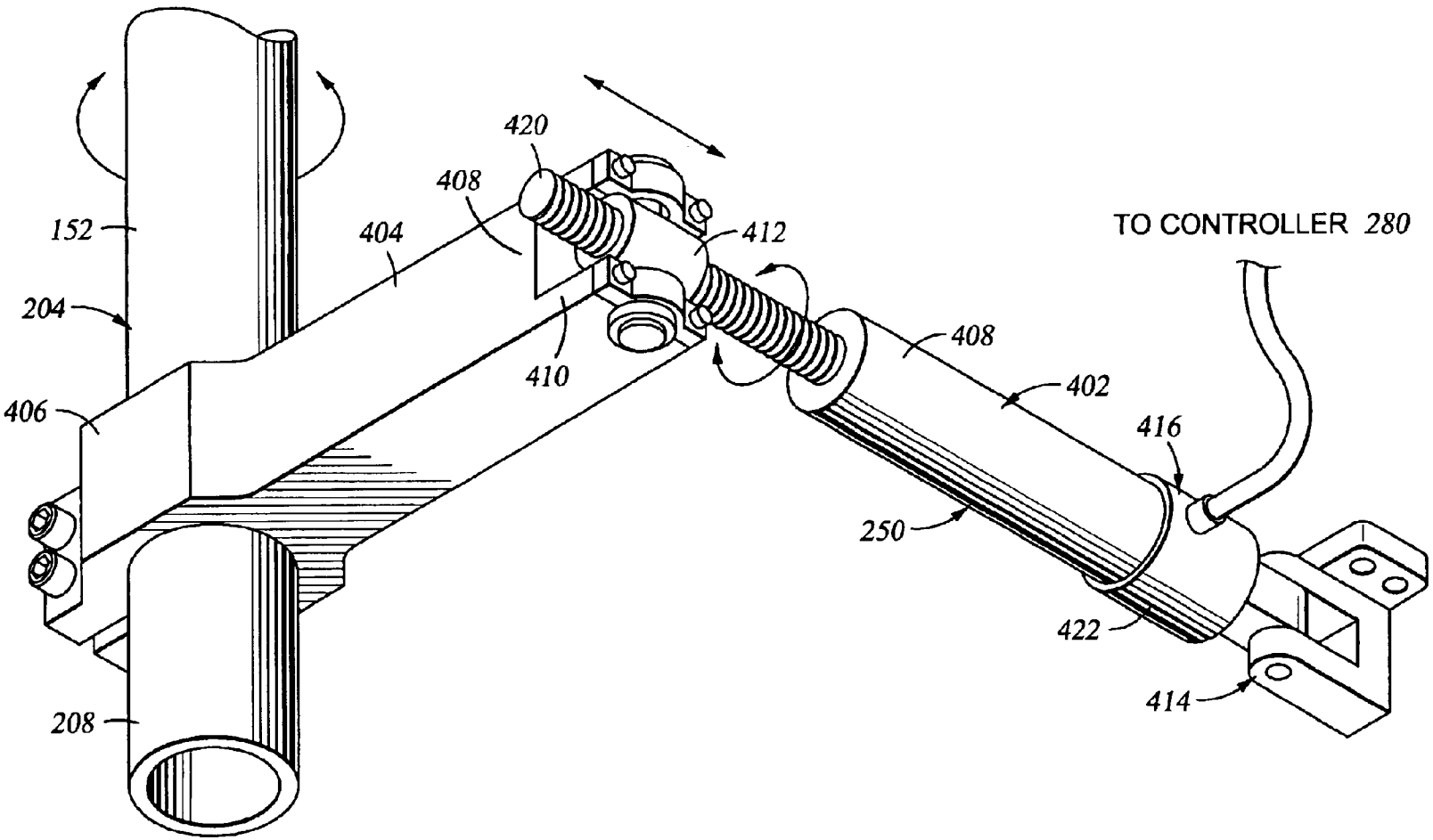
FIG. 4 is a bottom perspective view of one embodiment of a polishing fluid delivery arm.

FIG. 4 depicts a bottom perspective view of one embodiment of polishing fluid delivery arm assembly 152 having a ball screw actuator 402 to control the rotational position of the dispense arm 202. The ball screw actuator 402 is coupled to the lower portion 208 of the support member 204 by a control arm 404. The control arm 404 has a first end 406 coupled to the lower portion 208 of the support member 204 that extends below the base 140 of the polisher 108 and a second end 408. The second end 408 includes a bifurcated flange 410 configured to pivotally retain a drive nut 412 therebetween.

The ball screw actuator 402 has a mounting portion 416 that is coupled to the base 140 of the polisher 108 by a gimbal 414. A motor 418 is disposed on the mounting portion 416 and is coupled to the controller 280. A ball screw 420 or other thread form extends from the motor 418 and engages the drive nut 412. As the motor 420 rotates the ball screw 420, the drive nut 412 retained by the second end 408 of the control arm 404 is urged towards (or away from) the motor 418, thereby causing the support member 204 and dispense arm 202 to rotate.

A position sensor 422 is interfaced with the delivery arm assembly 152 to provide a metric indicative of the position of the dispense arm 202. The position sensor 422 may be any sensor suitable for providing positional information, such as linear displacement transducers, proximity switches and limit switches, among others. In one embodiment, the position sensor 422 is a rotary encoder coupled to at least one of the motor 418 or ball screw 420 for providing a metric indicative of the ball screw's rotation, which corresponds to a predefined advance of the drive nut 412 along the ball screw 420, from which the position of the dispense arm 202 and tube outlet end 224 may be resolved. The position sensor 422 may work in concert with limit switches (not shown) to provide reference coordinate information regarding of the range of motion of the dispense arm 202 at system start-up.

Figure 5:
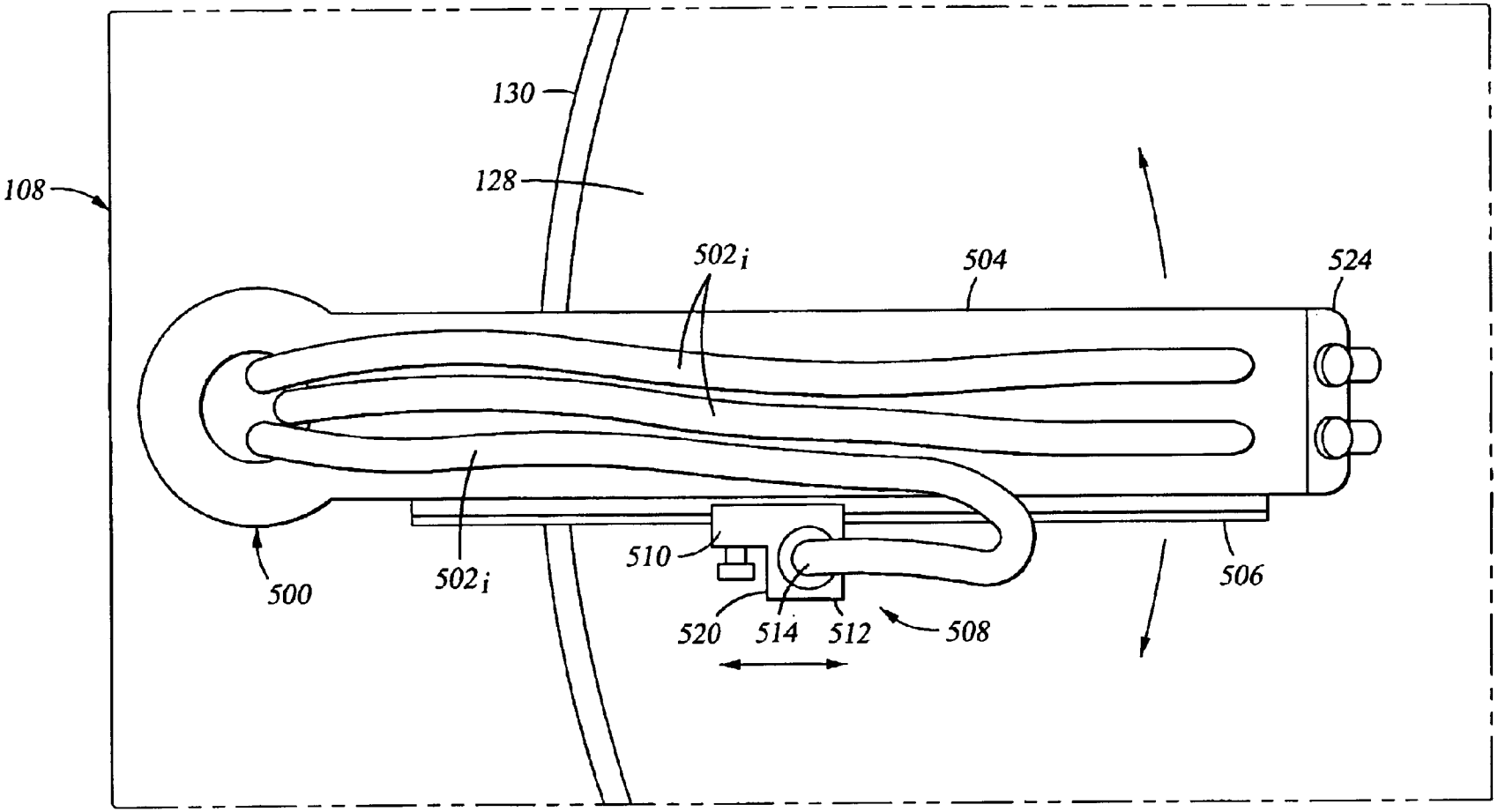
FIG. 5 is a top view of another embodiment of a polishing fluid delivery arm.

FIG. 5 depicts another embodiment of a polishing fluid delivery arm assembly 500. The delivery arm assembly 500 is substantially similar to the delivery arm assembly 152 described above, except wherein at least a first fluid delivery tube $\mathbf{502}_1$ of a plurality of fluid delivery tubes $\mathbf{502}_i$ is positionable longitudinally along a dispense arm 504 rotationally supported over a top surface of a polisher 108. In the embodiment depicted in FIG. 5, at least one of the fluid delivery tubes $\mathbf{502}_i$ is coupled to a distal end 524 of the dispense arm 504.

In one embodiment, the dispense arm 504 includes a track 506 along which a tube clamp 508 may be selectively positioned. The tube clamp 508 includes a first clamp 510 and a second clamp 512. The first clamp 510 is disposed through the tube clamp 508 and may be biased against the track 506 to secure the position of the tube clamp 508 along the lateral length of the dispense arm 504. The tube clamp 508 additionally includes a tube receiving passage 514 that accepts an outlet end 520 of the first fluid delivery tube $\mathbf{502}_1$. The second clamp 512 is configured to secure the first fluid delivery tube $\mathbf{502}_1$ in the tube receiving passage 514. Optionally, additional tube clamps 508 may be coupled to the track 506 to retain other tubes $\mathbf{502}_i$ at predefined intervals along the dispense arm 504. One dispense arm 504 that may be adapted to benefit from the invention is described in U.S. patent application Ser. No. 10/131,638, filed Apr. 22, 2002, by Vereen et al., which is incorporated by reference in its entirety.

Thus, a polishing fluid delivery system has been provided that advantageously reduces the incidence of particle collection and release to a polishing surface, thus decreasing the occurrence of substrate scratching and defect generation. In another aspect of the invention, a polishing fluid delivery system has been provided that controls the distribution of polishing fluid across the width of a polishing material, advantageously allowing the polishing rates across the profile of a substrate to be controlled.

While the foregoing is directed to the preferred embodiment of the present invention, other and further embodiments of the invention may be devised without departing from the basic scope thereof, and the scope thereof is determined by the claims that follow.

What is claimed is:

1. A polishing fluid delivery apparatus comprising:

a support member having a lower portion and an upper portion;

a dispense arm extending from the upper portion of the support member;

at least a first seamless polishing fluid delivery tube extending from at least the support member to an outlet coupled to the arm; and a first pinch valve interfacing with the first tube and adapted to provide a variable restriction to flow through the first tube.

2. The polishing fluid delivery apparatus of claim 1, wherein the support member further comprises:

a passage formed therein having the first tube routed therethrough.

3. The polishing fluid delivery apparatus of claim 1, wherein the pinch valve is mounted to at least one of the support member or the dispense arm.

4. The polishing fluid delivery apparatus of claim 1 further comprising:

a control arm extending from the lower portion of the support member; and an actuator coupled to the control arm and adapted to apply a bias to the control arm that rotates the dispense arm.

5. The polishing fluid delivery apparatus of claim 4 wherein the actuator is at least one of a gear motor, a harmonic drive, a linear actuator, a motorized lead screw, a hydraulic cylinder or a pneumatic cylinder.

6. The polishing fluid delivery apparatus of claim 4, wherein the actuator further comprises a ball screw.

7. The polishing fluid delivery apparatus of claim 4 further comprising:

a sensor adapted to provide a metric indicative of the rotation position of the dispense arm.

8. The polishing fluid delivery apparatus of claim 1 further comprising:

a polishing fluid supply having an outlet coupled to the first tube.

9. The polishing fluid delivery apparatus of claim 8 further comprising:

a second polishing fluid delivery tube having an outlet coupled to the dispense arm; and a second pinch valve interfacing with the second tube and adapted to provide a variable restriction to flow through the second tube.

10. The polishing fluid delivery apparatus of claim 9 further comprising:

a second polishing fluid supply having an outlet coupled to the second tube.

11. The polishing fluid delivery apparatus of claim 1 further comprising:

a flow meter interfacing with the first tube and adapted to provide a metric indicative of flow therethrough.

12. A polishing fluid delivery apparatus comprising:

a dispense arm rotatable about an axis located proximate a first end of the arm;

at least a one piece continuous, seamless polishing fluid delivery conduit extending from at least the first end of the arm to an outlet positioned along the arm; and a restricting device interfacing with exterior of the conduit for changing an interior sectional area bounded by the conduit.

13. The polishing fluid delivery apparatus of claim 12, wherein the restricting device is a first pinch valve.

14. The polishing fluid delivery apparatus of claim 12 further comprising:

a support member having a first end coupled to the dispense arm;

a control arm extending from a second end of the support member; and an actuator coupled to the control arm and adapted to apply a bias to the control arm that rotates the dispense arm.

15. The polishing fluid delivery apparatus of claim 14 wherein the actuator is at least one of a gear motor, a harmonic drive, a linear actuator, a motorized lead screw, a hydraulic cylinder or a pneumatic cylinder.

16. The polishing fluid delivery apparatus of claim 14, wherein the actuator further comprises a ball screw engaged with a drive nut pivotally coupled to the control arm.

17. The polishing fluid delivery apparatus of claim 14 further comprising:

a sensor adapted to provide a metric indicative of the rotation position of the dispense arm.

18. The polishing fluid delivery apparatus of claim 17 further comprising:

a controller associated with the actuator and the sensor, the controller adapted to selectively position the dispense arm in a first dispense position over a polishing surface and in at least a second dispense position over a different portion the polishing surface.

19. The polishing fluid delivery apparatus of claim 12 further comprising:

a polishing fluid supply having an outlet coupled to the conduit; and a flow meter interfacing with the conduit and adapted to provide a metric indicative of flow therethrough.

20. A polishing apparatus comprising:

a rotatable platen having a polishing surface;

a polishing head adapted to selectively retain a substrate against the polishing surface;

a polishing fluid dispense arm rotatable about an axis located proximate a first end of the arm;

a seamless polishing fluid delivery tube extending from at least e first end of the arm to an outlet coupled to a portion of the dispense arm positionable over the polishing surface; and a pinch valve adapted to variably bias a wall of the delivery tub to selectively create a flow restriction.

21. The polishing fluid delivery apparatus of claim 20 further comprising:

a support member having a first end coupled to the dispense arm;

a control arm extending from a second end of the support member; and an actuator coupled to the control arm and adapted to apply a bias to the control arm that rotates the dispense arm.

22. The polishing fluid delivery apparatus of claim 21 wherein the actuator is at least one of a gear motor, a harmonic drive, a linear actuator, a motorized lead screw, a ball screw, a hydraulic cylinder or a pneumatic cylinder.

23. The polishing fluid delivery apparatus of claim 21 further comprising:

a sensor adapted to provide a metric indicative of the rotation position of the dispense arm.

24. The polishing fluid delivery apparatus of claim 20 further comprising:

a polishing fluid supply having an outlet coupled to the delivery tube; and a flow meter interfacing with the delivery tube and adapted to provide a metric indicative of flow therethrough.

25. The polishing fluid delivery apparatus of claim 20, wherein the delivery polishing fluid delivery tube is an one piece continuous passage between the outlet to at least a point beyond a portion of the tube that interfaces with the pinch valve.

26. A polishing apparatus comprising:

a rotatable platen having a polishing surface;

a head adapted to selectively retain a substrate against the polishing surface;

a polishing fluid dispense arm rotatable about an axis located proximate a first end of the arm, at least one seamless continuous polishing fluid delivery tube extending from at least the first end of the arm to an outlet coupled to a portion of the positionable over the polishing surface; and a pinch valve engageable with the exterior of the delivery tube or changing an interior sectional area bounded by the delivery tube.

27. The polishing apparatus of claim 26 further comprising:

a polishing fluid supply having an outlet coupled to the delivery tube; and a flow meter interfacing with the delivery tube and adapted to provide a metric indicative of flow therethrough.

28. The polishing fluid delivery apparatus of claim 27 further comprising:

a support member having a first end coupled to the dispense arm;

a control arm extending from a second end of the support member;

a drive nut coupled to the control arm;

an actuator;

a lead screw driven by the actuator and engaging the drive nut to bias the control arm.

29. A method for controlling polishing fluid flow in a chemical mechanical polishing apparatus, comprising:

flowing polishing fluid through a continuous seamless tube extending from at least an end of a dispense arm that supports the tube to an outlet positioned to dispense the fluid on a polishing surface;

providing a restriction in the continuous tube using a flow control device that selectively changes the sectional area of the continuous tube; and actuating the flow control device to change the sectional area of the continuous tube wherein the flow control device is a pinch valve.

30. The method of claim 29, wherein the step of actuating the flow control device further comprises substantially removing the restriction and purging the tube.

31. A polishing fluid delivery apparatus comprising:

at least one flexible, seamless resilient fluid delivery tube having an inlet and an outlet and no internal physical anomalies and extending from at least an end of dispense arm that supports the tube to the outlet; and a restricting element engaging the tube and adapted to be op rated to apply force against the tube to modify the cross-sectional area of the tube at the point where the force is applied.

* * * * *

UNITED STATES PATENT AND TRADEMARK OFFICE

CERTIFICATE OF CORRECTION

PATENT NO. : 6,939,210 B2
APPLICATION NO. : 10/428914
DATED : May 2, 2003
INVENTOR(S) : Alexander S. Polyak and Avi Tepman It is certified that error appears in the above-identified patent and that said Letters Patent is hereby corrected as shown below:

In the Specification

Column 7, Line 66: Change “172” to --712--

Column 8, Line 1: Change the first occurrence of “or” to --of--

In the Claims

Column 11, Line 2: After “portion”, insert --of--

Column 11, Line 17: Change “e” to --the--

Column 11, Line 21: Change “tub” to --tube--

Column 12, Line 5: After “the”, insert --arm--

Column 12, Line 8: Change “or” to --for--

Column 12, Line 48: After “of”, insert --a--

Column 12, Line 48: Change “op rated” to --operated--

Signed and Sealed this

Eleventh Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 6,939,210 B2
APPLICATION NO. : 10/428914
DATED : September 6, 2005
INVENTOR(S) : Alexander S. Polyak and Avi Tepman It is certified that error appears in the above-identified patent and that said Letters Patent is hereby corrected as shown below:

In the Specification

Column 7, Line 66: Change “172” to --712--

Column 8, Line 1: Change the first occurrence of “or” to --of--

In the Claims

Column 11, Line 2: After “portion”, insert --of--

Column 11, Line 17: Change “e” to --the--

Column 11, Line 21: Change “tub” to --tube--

Column 12, Line 5: After “the”, insert --arm--

Column 12, Line 8: Change “or” to --for--

Column 12, Line 48: After “of”, insert --a--

Column 12, Line 48: Change “op rated” to --operated--

This certificate supersedes Certificate of Correction issued September 11, 2007.

Signed and Sealed this

Ninth Day of October, 2007

JON W. DUDAS
*Director of the United States Patent and Trademark Office*